United States Patent [19]

Creel

[11] Patent Number: 4,684,876

[45] Date of Patent: Aug. 4, 1987

[54] VOLTAGE REGULATING DEVICE USING TRANSISTOR MEANS FOR VOLTAGE CLIPPING AND HAVING LOAD CURRENT COMPENSATION

[76] Inventor: Kirby B. Creel, 506 E. 90th, Kansas City, Mo. 64131

[21] Appl. No.: 867,131

[22] Filed: May 27, 1986

[51] Int. Cl.[4] ..... G05F 1/445

[52] U.S. Cl. ..... 323/268; 307/568; 323/275

[58] Field of Search ..... 323/265, 266, 268, 270, 323/274, 275, 303, 226, 246, 245, 294, 273; 307/568; 361/91; 363/89

[56] References Cited

U.S. PATENT DOCUMENTS

| | | | |
|---|---|---|---|
| 3,475,677 | 10/1969 | Swinehart et al. | 323/245 |
| 3,593,111 | 7/1971 | Moerlein | 323/303 |
| 3,652,921 | 3/1972 | Nye | 323/294 |
| 3,723,854 | 3/1973 | Kita | 323/246 |
| 4,437,148 | 3/1984 | Suranyi | 363/89 |

FOREIGN PATENT DOCUMENTS

| | | | |
|---|---|---|---|
| 2031439 | 12/1971 | Fed. Rep. of Germany | 323/246 |
| 2625307 | 12/1977 | Fed. Rep. of Germany | 363/89 |
| 122746 | 10/1978 | Japan | 323/265 |
| 497565 | 7/1976 | U.S.S.R. | 323/268 |

*Primary Examiner*—William H. Beha, Jr.

*Attorney, Agent, or Firm*—Schmidt, Johnson, Hovey & Williams

[57] ABSTRACT

An alternating current voltage regulator is provided which clips the maxima of the positive and negative portions of the incoming alternating current wave form at a regulated level thereby producing alternating current output wave form, and which varies the regulated output voltage level in response to changes in output current. The preferred regulator includes two electrically independent regulating sections, one for clipping the positive portion of the alternating current wave form and the other for clipping the negative portion of the incoming alternating current wave form. Preferably each independent regulating section includes means for sensing the positive and negative portions of the output current respectively and for varying the regulated level of the positive and negative output voltages respectively in response thereto. A second embodiment is illustrated using the amplifier as part of the current sensing means for use with high load current applications.

3 Claims, 5 Drawing Figures

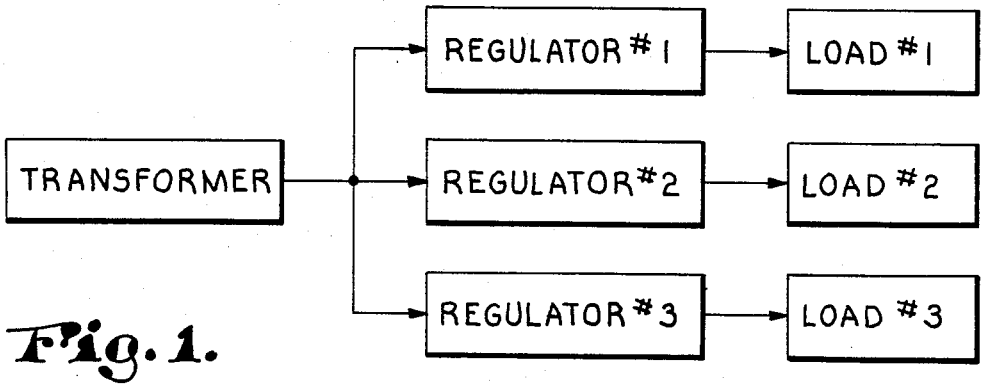
Fig. 1.
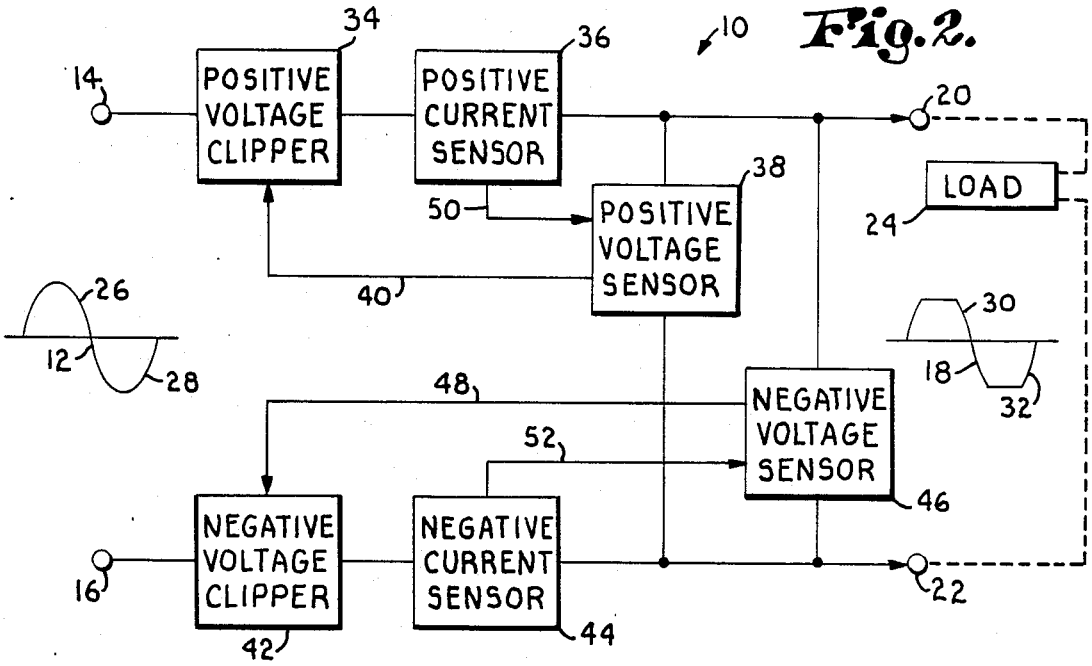
Fig. 2.
Fig. 5.
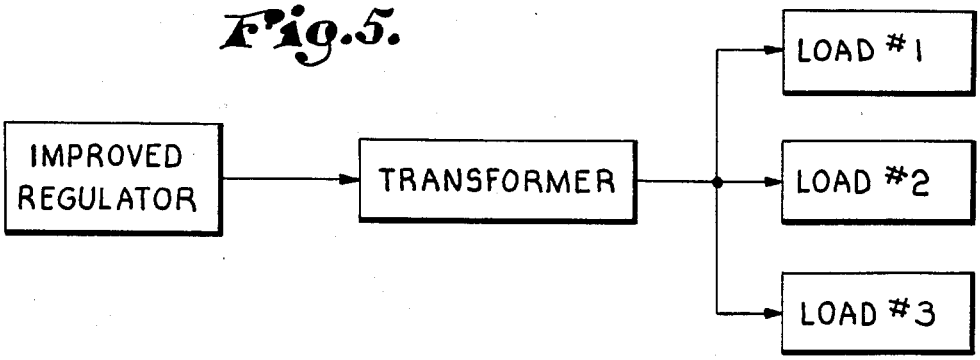

VOLTAGE REGULATING DEVICE USING TRANSISTOR MEANS FOR VOLTAGE CLIPPING AND HAVING LOAD CURRENT COMPENSATION

BACKGROUND OF THE INVENTION

1. Field of the Invention

This invention relates to an alternating current voltage regulator which clips an alternating current input wave form at a controlled level to produce a regulated alternating current output voltage and which automatically varies the controlled level in response to changes in load current. More particularly, the invention is concerned with a device having two electrically independent regulating sections, one for the positive portion of the alternating current cycle and the other for the negative portion of the alternating current cycle, which sections are able to independently adjust the controlled level of the regulated output voltage.

2. Description of the Prior Art

Typical alternating current voltage regulators produce a regulated alternating current output by using a direct current power source in combination with an oscillator to produce a voltage regulated, alternating current output wave form. The D.C. power source is usually contained within the regulator to receive and filter a standard alternating current input (e.g., 120 V.A.C.). This arrangement is expensive because of the numerous components involved and is inefficient from a power-consumption standpoint because of the losses incurred in amplifying an oscillator generated signal to the proper voltage level.

A second problem with known alternating current voltage regulators is that they do not automatically increase their output voltage in response to increases in load current. Transmission line losses occurring between a regulator and the load typically go up as load current goes up. Because of this, voltage actually delivered to the load may go down even though the output of the regulator remains at the proper level.

This problem is particularly acute if a transformer is part of the regulator load. As load current from the secondary of the transformer goes up, the internal "copper losses" of the transformer go up also thus causing a drop in secondary output voltage even though the regulator supplying the primary of the transformer continues to provide a constant, regulated voltage.

Because of the line-loss problem, the arrangement shown in FIG. 1 is typically used wherein each individual load is supplied by its own dedicated regulator which in turn is supplied by its secondary of the transformer. In this way, each dedicated regulator compensates for any voltage drop in the secondary of the transformer and furthermore ensures a constant output voltage delivered to each load. This arrangement while effective is expensive because it requires a dedicated regulator for each load rather than one regulator supplying the primary of the transformer.

SUMMARY OF THE INVENTION

The problems discussed above are solved by the regulator disclosed herein. That is to say, the regulator of the present invention clips the alternating current input voltage wave form to produce an output voltage with a regulated control maximum which regulated voltage level changes with changes in load current.

Broadly speaking, a preferred voltage regulator in accordance with the present invention includes a voltage clipping means operably coupled to the input terminals of the regulator for clipping the maxima of the relatively positive and relatively negative portions of the input voltage at a controlled level corresponding to and in response to a control signal received by the voltage clipping means to thereby create a regulated output voltage at the output terminals; the regulator further includes a voltage sensing means operably coupled with the output terminals and with the voltage clipping means for sensing the magnitude of the output voltage and for producing the control signal in response thereto. Alternatively, the regulator may include a current sensing means coupled in series with the load for sensing the magnitude of the output current delivered to the load and for varying the level of the regulated output voltage in predetermined, correlated response to variations in the sensed magnitude of the output current.

In preferred forms, the regulator includes electrically independent sections for respectively controlling the positive voltage portions and the negative voltage portions of the input voltage wave form respectively. The regulator may also include an amplifier in the current sensing means for amplifying a current signal received therefrom.

BRIEF DESCRIPTION OF THE DRAWINGS

FIG. 1 illustrates in block diagram form a typical prior art use of three regulators supplied from a secondary transformer and used to individually supply three different loads;

FIG. 2 is a block diagram illustration of the present regulator also showing an alternating current voltage input and a clipped alternating current voltage output;

FIG. 5 is a block diagram illustrating use of the improved regulator described herein.

DESCRIPTION OF THE PREFERRED EMBODIMENTS

Figure 3:
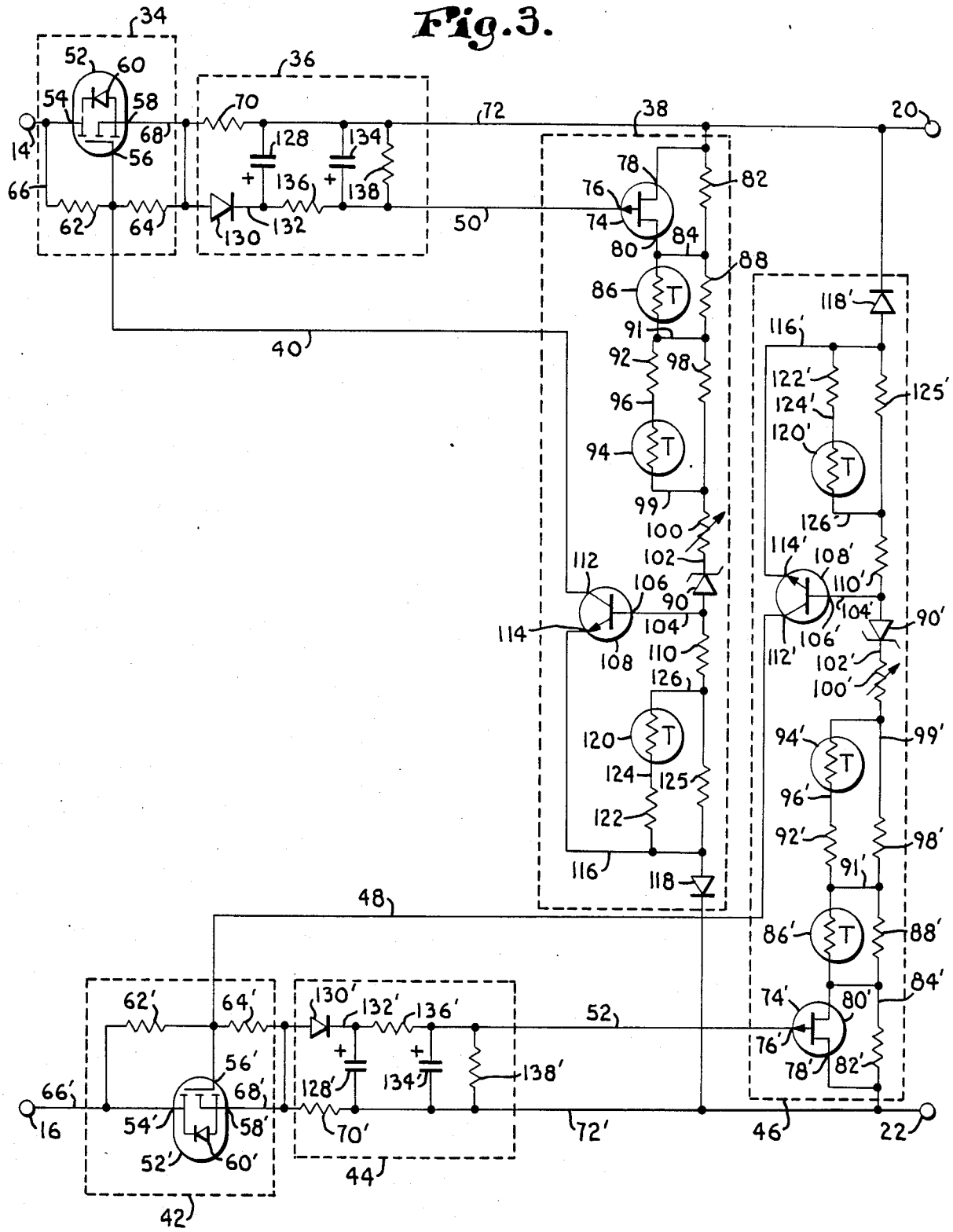
FIG. 3 is an electrical schematic of a first preferred regulator embodiment for use in connection with low-current loads.

The operation of the present invention can best be understood by initially referring to the block diagram illustration of FIG. 2. Preferred regulator 10 receives an alternating current input voltage 12 at terminals 14 and 16. Regulator 10 produces output voltage wave form 18 at terminals 20 and 22 which output is delivered to a load 24 via appropriate connections. Broadly speaking, regulator 10 produces output voltage 18 by clipping positive voltage portion 26 and negative voltage portion 28 of input voltage 12. That is, regulator 10 limits the magnitude of the respective positive and negative portions of the input wave form 12 to produce the positive output wave form 30 and negative output wave form 32 by limiting the magnitude of the output voltage to a regulated maximum.

Regulator 10 performs its regulating function by separately clipping positive input voltage 26 and negative input voltage 28 by way of two electrically independent positive and negative voltage control sections. The positive voltage control section includes positive voltage clipper 34, positive current sensor 36 and positive voltage sensor 38. As input voltage at terminals 14,16 initially begins to rise positive, positive voltage clipper 34 and positive current sensor 36 transmit the input voltage essentially unattenuated to terminals 20 and 22. As the input voltage rises positively to the controlled voltage level, positive voltage sensor 38 causes clipper 34 to limit any further increase in output voltage by way of a control signal over line 40. During the time positive input voltage 26 is above the controlled voltage level, the output voltage at terminals 20,22 is limited to a maximum control voltage level which limitation causes the flattened peak of positive output voltage wave form 30. When input voltage 26 drops below the controlled maximum voltage level, clipper 34 begins again to transmit input voltage essentially unattenuated through to terminals 20,22.

The section of regulator 10 for controlling the negative portion of the alternating current cycle includes negative voltage clipper 42, negative current sensor 44 and negative voltage sensor 46. Negative voltage clipper 42 transmits negative input voltage 28 essentially unattenuated until the magnitude of input voltage 28 reaches the controlled voltage level. When negative voltage sensor 46 detects negative output voltage 18 at the controlled level, sensor 46 causes clipper 42 via control signal on line 48 to clip negative input voltage 28 to form negative output voltage wave form 18. Sensor 46 in combination with clipper 42 continue to prevent the output voltage from rising above the controlled level during the time the magnitude of negative input voltage 28 rises above the controlled level which causes the flattened peak of output wave form 32. When the magnitude of negative input voltage 28 drops below the controlled voltage level, sensor 46 then allows clipper 42 to transmit the input voltage essentially unattenuated to terminals 20,22.

Positive current sensor 36 senses the average magnitude of the positive output current delivered to load 24 over a plurality of previous positive portions of the alternating current cycle. As the average positive portion current delivered to load 24 rises over time, sensor 36 causes sensor 38 to increase the controlled voltage level of positive voltage output 30 via a current signal delivered on line 50 to sensor 38. Conversely, a decrease in average current flow, as sensed by sensor 36, causes positive voltage sensor 38 to control the maximum output voltage at a lower level. Negative current sensor 44 similarly acts via current signal over line 52 to cause negative voltage sensor 46 to control a negative output voltage 32 at a higher level when a higher negative portion load current is sensed and to conversely control at a lower controlled voltage when sensor 44 detects a lower average current flow.

FIG. 3 shows a first embodiment of the preferred regulator and components analogous to those discussed in FIG. 2 are numbered the same. Embodiment of FIG. 3 is intended for use with load currents less than about 10 amperes. For the sake of example, the following discussion assumes regulator 10 has been designed for an input of 115 V.A.C. R.M.S. (root mean square), and a nominal peak ouptut of 110 volts. As such, values and types of the components are shown in parentheses when first mentioned which values and types are adapted for use in this exemplary application.

The positive voltage regulating section of regulator 10 broadly includes positive voltage clipper 34, positive current sensor 36 and positive voltage sensor 38. Regulator 10 receives an alternating current input voltage at terminals 14,16 and delivers an alternating current output voltage at terminals 20,22 which are appropriately connected to a load (not shown in FIG. 3). Positive voltage clipper 34 includes field effect transistor 52 (type MTP2N18) which includes drain terminal 54, gate terminal 56, source terminal 58 and diode 60. Clipper 34 also includes resistors 62 (62,000 ohms) and 64 (3,000,000 ohms) coupled in series by line 40 which is also coupled to gate terminal 56. Resistors 62,64 are coupled in parallel to drain terminal 54 and source terminal 58 of field effect transistor 52 via lines 66 and 68 respectively. Line 66 is also connected with input terminal 14.

As positive input voltage begins to rise at terminal 14 with reference to terminal 16, a voltage drop soon begins to develop across field effect transistor terminals 54 and 58 and also resistors 62,64. Because resistor 64 is so large compared to resistor 62, nearly all of the voltage drop across these resistors is across resistor 64 which in turn via line 40 is impressed on gate terminal 56. This turns on field effect transistor 52 quickly following a positive voltage rise at terminal 14. In this way, field effect transistor 52 initially transmits input voltage essentially unattenuated.

Positive current sensor 36, which will be discussed in more detail below, includes load resistor 70 (2.7 ohms). Because of the low value of resistor 70, the output voltage from field effect transistor 52 on line 68 is transmitted through resistor 70 essentially unattenuated to output terminal 20 via line 72.

Return current from the load returns via output terminal 22, line 72', load resistor 70' of negative current sensor 44, line 68' through forward biased diode 60' of field effect transistor 52' and via line 66' to input terminal 16.

Positive voltage sensor 38 is connected between terminals 20,22 via line 72 and 72'. In this way, the output voltage existing at terminals 20,22 is impressed upon positive voltage sensor 38.

Sensor 38 includes transistor 74 (type 2N5460) which includes gate terminal 76, drain terminal 80, and source terminal 78. Transistor 74 is coupled in parallel with resistor 82 (3,300 ohms) via lines 72 and 84 as shown. Gate 76 receives a current signal from positive current sensor 36 via line 50. As the voltage on line 50 increases to gate 76, the resistance between drain 80 and source 78 increases which increases the resistance of the parallel network of transistor 74 and resistor 82. This increased resistance increases the voltage drop across this part of sensor 38. Thus, an increase in average current flow to the load as detected by positive current sensor 36 causes an increased voltage via line 50 to thereby increase the overall voltage drop across transistor 74.

The next part of sensor 38 includes a load temperature compensation section which includes positive temperature coefficient thermistor 86 (15,000 ohms) coupled in parallel with resistor 88 (820 ohms) via lines 84 and 91. Thermistor 86 is thermally coupled with the load preferably by epoxy bonding. As the load temperature increases, the resistance of thermistor 86 increases to thereby increase the resistance of parallel network of thermistor 86 and resistor 88. The increased resistance causes an increased voltage drop across this section of sensor 38. Conversely, a lowering of load temperature lowers the voltage drop across this section.

The next section of sensor 38 is a temperature compensation section for zener diode 90 (type IN4764). This temperature compensation section includes resistor 92 (15,000 ohms) coupled in series with thermistor 94 via line 96. Resistor 92 and thermistor 94 are in turn coupled in parallel with resistor 98 (3,600 ohms) via lines 91 and 99 respectively. Thermistor 94 is thermally coupled with zener diode 90 preferably by epoxy bonding. As the temperature of diode 90 goes up, the resistance of thermistor 94 goes down and so does the voltage drop across the network composed of resistors 92,98 and thermistor 94. This action compensates for any increase in zener voltage of diode 90 caused by a temperature increase of diode 90.

Adjustable resistor 100 (1,000 ohms) is included in sensor 38 to provide manual adjustment of the regulated voltage level. As the resistance value of resistor 100 is increased, voltage drop across resistor 100 increases also which causes regulator 100 to control the maximum output voltage at a higher level.

The cathode of zener diode 90 is connected to adjustable resistor 100 via line 102. The zener voltage of diode 90 serves as the primary reference against which the maximum output voltage level is controlled.

The anode of diode 90 is connected via line 104 to base 106 of transistor 108 (type MPS-A42) and to one side of resistor 110 (15 ohms). Collector 112 of transistor 108 is coupled via line 40 to one side of resistors 62,64 and to gate 56 of transistor 52. Emitter 114 of transistor 108 is connected via line 116 to the cathode of blocking diode 118 (type 1N4004).

The next section of positive voltage sensor 38 is composed of a temperature compensation network for transistor 108. This network includes thermistor 120 (1,000 ohms) coupled in series with resistor 122 (750 ohms) via line 124. Thermistor 120 and resistor 122 are coupled in parallel with resistor 125 (330 ohms) via lines 126 and 116 respectively. Line 126 is connected to the other side of resistor 110. Thermistor 120 is thermally connected with transistor 108 preferably by epoxy bonding and together with resistors 110, 124 and 122 compensates for changes in the conductance between collector 112 and emitter 114 of transistor 108 due to changes in temperature of transistor 108. As the temperature of transistor 108 rises, the resistance of thermistor 120 decreases which decreases the resistance of the temperature compensation network which in turn reduces current to base 106 from zener diode 90.

The last element of sensor 38 is blocking diode 118 and which is connected to line 72' to thus complete the connection of sensor 38 between terminals 20,22. Diode 118 serves to block current flow through sensor 38 during the negative voltage portion of the output voltage cycle but allows current flow during the positive voltage portion.

In the operation of the positive voltage sensor 38, the voltage impressed on terminals 20,22 is also impressed on sensor 38. Assume a 115 volt A.C. R.M.S. sine wave input that is just beginning to rise positive; assume also that the regulated voltage set point is 110 volts and that the input voltage at terminals 14,16 is rising positive. When the output voltage reaches 110 volts, the values chosen for the components of sensor 38 allow a voltage drop across zener diode 90 of 100 volts. Up to this point, field effect transistor 52 has transmitted the input voltage at terminals 14,16 essentially unattenuated. As the voltage drop across diode 90 rises incrementally above 100 volts (which is its zener voltage), zener 90 begins to conduct current via line 104 to base 106 of transistor 108. As base current begins to turn on transistor 108, transistor 108 begins to conduct from the collector to the emitter which starts reducing voltage via line 40 on gate 56 of field effect transistor 52.

As gate voltage on field effect transistor 52 begins to drop, the resistance from drain 54 to source 58 begins to rise in an amount just sufficient to maintain the output voltage to terminals 20,22 at 110 volts. The input voltage at terminals 14,16 rises to a peak of 170 volts which means that field effect transistor 52 experiences a maximum voltage drop of about 60 volts while maintaining an output voltage at 110 volts.

Field effect transistor 52 used in this way is very unusual in that field effect transistors are usually used for on-off switching; however, field effect transistor 52 is used in a very narrow operating range on its operating curve near cutoff.

As one skilled in the art will appreciate, any change in the resistance values of the components of sensor 38 changes the voltage drop experienced by diode 90 which changes the regulated voltage level at terminals 20,22. For example, if the resistance value of adjustable resistor 100 is increased, the voltage drop across resistor 100 increases which decreases the voltage drop across diode 90 which, through the operation described above, allows a higher voltage to exist on output terminals 20,22 before diode 90 receives its zener voltage and begins to conduct. Similarly, an increase in the temperature of the load itself causes the resistance value of thermistor 86 to increase which correspondingly decreases the voltage drop across zener 90 which causes an increase in the regulated voltage level at terminals 20,22.

An increase in the operating temperature of diode 90 causes an increase in the zener voltage of diode 90 which would tend to undesirably increase the regulated voltage level; however, when diode 90 temperature goes up, the resistance of thermistor 94 goes down which decreases the voltage drop across the network of thermistor 94 and resistors 92,98 which decreases the voltage drop across positive voltage sensor 38 in just the amount necessary to compensate for the rise in zener voltage due to temperature increase.

Thermistor 120 operates in a similar manner to compensate for operating changes of transistor 108 caused by increased operating temperature. As the temperature of transistor 108 goes up which causes an increase in conductance between emitter 120 and collector 114, the resistance value of thermistor 120 goes down which causes the network composed of thermistor 120 and resistors 110, 124 and 122 to decrease the base current to base 106 thereby decreasing the conductance of transistor 108 in the amount equal to the increase in conductance caused by the increase in temperature.

Positive current sensor 36 serves to increase the regulated voltage level directly with an increase in average load current. Load current causes a voltage drop across load resistor 70 which charges up capacitor 128 (1.5 microfarads) via line 68, diode 130 (type 1N5817) and line 132. Additionally, voltage drop across resistor 70 charges up capacitor 134 (1.5 microfarads) via resistor 136 (10 ohms) on line 50. Resistor 138 (560,000 ohms) is connected in parallel with capacitor 134 via lines 50 and 72. The network composed of capacitors 128,134 and resistors 136,138 forms a PI filter which is designed to have a time constant of about fifty times of that of the alternating current cycle for which the circuit is used and is especially useful to smooth out "ripple" with a high frequency input. Thus, the output voltage of positive current sensor 36 on line 50 represents an average current value for a plurality of previous alternating current cycles. Diode 130 prevents capacitors 128,134 from discharging during the negative portion of the alternating current cycle.

In operation, positive current sensor 36 causes the output voltage on line 50 to increase with an increase in average positive current flow. The increased voltage on line 50 to gate 76 of transistor 74 causes an increase in the resistance value between drain 80 and source 78 of transistor 74 which increases the resistance value of the network composed of transistor 74 and resistor 82. The increased resistance value of this network decreases the voltage drop across diode 90 which increases the regulated voltage level. Similarly, a decrease in voltage on line 50 causes a decrease in the regulated voltage level for terminals 20,22. In this way, an increase in load current as sensed by sensor 36 increases the output clipped voltage level.

When the input voltage goes into the negative portion of the alternating current cycle, blocking diode 118 prevents operation of positive voltage sensor 38 during this portion of the cycle, diode 130 prevents the capacitors of positive current sensor 36 from discharging, and diode 60 of field effect transistor 52 causes return load current flow to bypass through to terminal 14. Thus, during the negative voltage portion of the alternating current cycle, positive voltage clipper 34, positive current sensor 36 and positive voltage sensor 38 allow transmission of the negative portion of the alternating current input essentially unattenuated except for the minor effect of load resistor 70.

Negative voltage clipper 42, negative current sensor 44, and negative voltage sensor 46 function exactly analogous to the positive portion components described above except to regulate the negative portion of the alternating current cycle. Analogous components are numbered the same except with the addition of a "prime" to the number. As one skilled in the art will appreciate, the positive and negative cycle regulating components are electrically independent which feature allows independent adjustment of the regulated clipped voltage level of the positive voltage portion and negative voltage portion.

Figure 4:
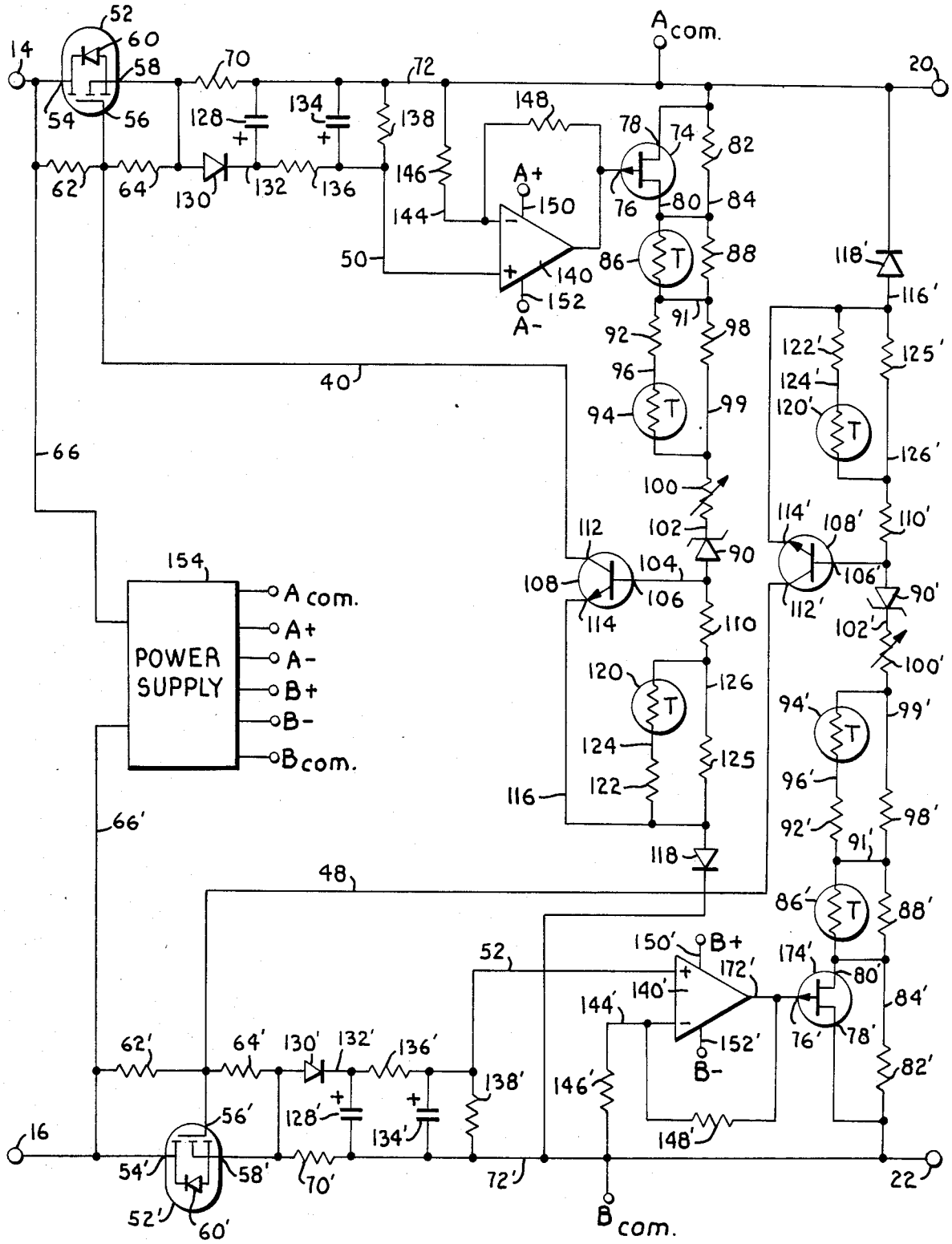
FIG. 4 is an electrical schematic diagram of a second preferred regulator embodiment for use in connection with high-current loads.

The embodiment illustrated in FIG. 4 is very similar to that of FIG. 3 and analogous components are numbered the same. The primary difference between the embodiment of FIG. 4 and that of FIG. 3 is that the second embodiment uses an amplifier in each current sensor 36,44 to amplify the integrated load current voltage signal. This is desirable in applications of device 10 when load currents are high, for example over 10 amperes, to avoid excessive power losses across load resistor 70. In the embodiment of FIG. 4, a very low value load resistor 70 chosen according to anticipated load current is used to avoid excessive power losses, but in doing so, the integrated voltage signal across capacitors 128,134 is correspondingly low which might not be enough to control transistor 74.

As a consequence, line 50 is connected to the positive terminal of conventional 741-type operational amplifier 140. The output of amplifier 140 is then connected via line 142 to gate 76 of transistor 74. The negative terminal of amplifier 140 is referenced to the load side of resistor 70 via line 144, resistor 146, and line 72. The gain of amplifier 140 is a designer's choice determined by the value of resistor 148 connected between output line 142 and negative terminal input line 144. Operating power to amplifier 140 is provided from terminals A+ and A− via lines 150 and 152 respectively. A corresponding amplifier 140' is provided for negative portion regulator 32 connected in the same way to perform the same functions on the negative voltage portion of the alternating current input cycle. Terminal $A_{com}$ is common reference terminal for the power supplied to amplifier 140 at line 72 as shown.

A conventional power supply 154 is preferably included to supply operating voltages to amplifiers 140 and 140'; such inclusion is optional if another source of operating voltage is available. Power supply 154 is supplied with input power via lines 66 and 66' respectively and provides the output at terminals A+ (e.g., +12 V.D.C.), A− (e.g., −12 V.D.C.) and $A_{com}$ and in a similar manner B+, B−, and $B_{com}$.

The operation of regulator 10 of the second embodiment is the same as that of FIG. 3 except for the inclusion of amplifiers 140 and 140'. As discussed above, the voltages in this embodiment at line 50 are typically too low to properly operate transistor 74. Amplifier 140 amplifies the signal at its positive input terminal to its output on line 142 to the gate of transistor 74 which then operates the same as that described with FIG. 3. Amplifier 140' performs the analogous function for negative portion regulator.

With reference to the above description, one can readily appreciate the advantages of an alternating current regulator in accordance with the present invention. For example, the regulator described herein clips an incoming input wave form to form a regulated output wave form and thereby avoids the expense and power losses of prior art devices which generate an alternating current output using a power supply and oscillator.

FIG. 5 further exemplifies a useful application of the present invention to supply the primary of a transformer, the secondary of which supplies a plurality of loads. The improved regulator is designed so that an increase in load current results in the regulator increasing its regulated output voltage precisely the amount necessary to maintain the desired regulated voltage on the transformer secondary despite any transformer "copper losses" or other transmission line losses. Thus, the wasteful inclusion of a plurality of regulators as in FIG. 1 is avoided.

The embodiments of the present invention as described above were described in terms of an example using a 115 volts R.M.S. sine wave input to produce an alternating current regulated voltage clipped at 110 volts. One skilled in the art will appreciate that these embodiments can be used on a wide variety of frequencies, not just household 60 hertz, and additionally the present invention is useful for different shaped input waves as well, for example square wave, triangle wave and so forth, and as such the values and uses described herein for the purpose of example should in no way be considered limiting upon the scope of the present invention.

Having described the preferred embodiments of the present invention, what is claimed and desired to be secured by Letters Patent is:

1. In an alternating current voltage regulator for use between a source of alternating current input voltage and a load, the regulator including input terminals adapted for coupling with the source and output terminals adapted for coupling with the load, said input voltage including a relatively positive portion and a relatively negative portion, the regulator comprising:

voltage clipping means, operatively coupled with the input terminals and adapted for receiving a control signal, for clipping the maxima of the relatively positive and relatively negative portions of the input voltage at a level corresponding to and in response to said control signal to create an output voltage at a regulated level at the output terminals;

voltage sensing means operatively coupled with the output terminals and with said voltage clipping means for sensing the magnitude of the output voltage and for producing said control signal in response thereto; and current sensing means coupled in a series relationship with said load for sensing the magnitude of said output current, said current sensing means including means for varying the regulated level of the output voltage in a predetermined, correlated response to variations in the sensed magnitude of said output current, said voltage clipping means including positive portion clipping means for clipping the maxima of the positive portion of the input voltage in response to a positive portion control signal to create a regulated positive portion output voltage, and negative portion clipping means for clipping the maxima of the negative portion of the input voltage in response to a negative portion control signal to create a regulated negative portion output voltage, said voltage sensing means including positive portion voltage sensing means for sensing the magnitude of said positive portion output voltage and for producing said positive portion control signal in response thereto, and negative portion voltage sensing means for sensing the magnitude of said negative portion output voltage and for producing said negative portion control signal in response thereto, said current sensing means including positive portion current sensing means for sensing the average magnitude of the positive portion of the output current existing over a predetermined plurality of alternating current cycles, and for providing a correlated positive portion current signal in response thereto, and negative portion current sensing means for sensing the average magnitude of the negative portion of the output current existing over a predetermined plurality of alternating current cycles, and providing a correl ated negative portion current signal in response thereto, said positive portion voltage sensing means including means for receiving said positive portion current signal and for varying said positive portion output voltage in response thereto, said negative portion sensing means including means for receiving said negative portion current signal and for varying said negative portion output voltage in response thereto.

2. The regulator as set forth in claim 1, further including temperature compensating means thermally coupled with the load for sensing the temperature of the load and for varying said output voltage in a predetermined response to said sensed temperature.

3. The regulator as set forth in claim 1, said voltage clipping means including a field effect transistor.

* * * * *